US006368172B1

(12) United States Patent
Travis

(10) Patent No.: US 6,368,172 B1
(45) Date of Patent: Apr. 9, 2002

(54) WATER GLIDER

(76) Inventor: Charles Travis, 318 Main St., Benton, KY (US) 42025

( * ) Notice: Subject to any disclaimer, the term of this patent is extended or adjusted under 35 U.S.C. 154(b) by 0 days.

(21) Appl. No.: 09/714,222

(22) Filed: Nov. 17, 2000

Related U.S. Application Data

(60) Provisional application No. 60/168,618, filed on Dec. 3, 1999.

(51) Int. Cl.[7] ..... B63B 7/04; B63B 35/73

(52) U.S. Cl. ..... 441/65; 114/352; 441/79

(58) Field of Search ..... 114/253, 352; 441/65, 72, 79

(56) References Cited

U.S. PATENT DOCUMENTS

| | | | | |
|---|---|---|---|---|
| 2,910,708 | A | | 11/1959 | Albright |
| 3,042,944 | A | | 7/1962 | Basey et al. |
| 3,082,443 | A | * | 3/1963 | Kimura |
| 3,092,857 | A | | 6/1963 | Churchman |
| 3,123,373 | A | | 3/1964 | Antcliff |
| 3,156,935 | A | | 11/1964 | Long |
| 3,237,222 | A | | 3/1966 | Frost |
| 3,512,195 | A | * | 5/1970 | Porsche |
| 3,580,598 | A | * | 5/1971 | de Pauw |
| 3,635,490 | A | * | 1/1972 | Demaree et al. |
| 5,100,354 | A | | 3/1992 | Woolley et al. |
| 5,349,918 | A | * | 9/1994 | Elie |

FOREIGN PATENT DOCUMENTS

| | | |
|---|---|---|
| CA | 945594 | 4/1974 |
| GB | 1004487 | 9/1965 |

* cited by examiner

*Primary Examiner*—Sherman Basinger
(74) *Attorney, Agent, or Firm*—Richard C. Litman

(57) ABSTRACT

A double-hulled, single-seat water glider, adapted to be towed behind a motorboat, comprises a unibody frame having a tilted front end. A detachable extension is provided to accommodate a second passenger. Aerodynamic stabilizer structure is provided on each side of the glider to prevent capsizing.

8 Claims, 4 Drawing Sheets

WATER GLIDER

CROSS-REFERENCE TO RELATED APPLICATION

This application claims the benefit of U.S. Provisional Patent Application Ser. No. 60/168,618, filed Dec. 3, 1999.

BACKGROUND OF THE INVENTION

1. FIELD OF THE INVENTION

The present invention relates to watercraft, and more specifically to recreational apparatus that can be towed behind a motorboat.

2. DESCRIPTION OF RELATED ART

Water skiing has become a highly popular sport on the lakes and waterways of resort areas. However, the sport requires a high degree of coordination, skill and dexterity. Unfortunately, these physical characteristics are not possessed by all persons who might want to experience the exhilaration of being towed behind a fast-moving motor boat. A safe and user-friendly apparatus that would permit less physically gifted persons to experience the joys of water skiing would surely be a welcomed addition in the art.

The prior art discussed below is relevant to developments in watercraft prior to my invention.

U.S. Pat. No. 2,910,708 issued to W. A. Albright on Nov. 3, 1959; U.S. Pat. No. 3,042,944 issued to D. L. Basey et al. on Jul. 10, 1962; U.S. Pat. No. 3,092,857 issued to F. L. Churchman on Jun. 11, 1963; U.S. Pat. No. 3,123,373 issued to W. T. Antcliff on Mar. 3, 1964; U.S. Pat. No. 3,156,935 issued to H. O. Long on Nov. 17, 1964; U.S. Pat. No. 3,237,222 issued to R. Frost on Mar. 1, 1966; U.S. Pat. No. 5,100,354 issued to Woolley et al. on Mar. 31, 1992; British Patent No. 1,004,487 published on Sep. 15, 1965; Canadian Patent No. 945,594 issued Apr. 16, 1974 all disclose water sport apparatus which accommodate only a single passenger.

None of the above inventions and patents, taken either singly or in combination, is seen to disclose a stable, single or double passenger water sport apparatus as will subsequently be described and claimed in the instant invention.

SUMMARY OF THE INVENTION

The present invention is a double-hulled water glider adapted to be towed behind a motorboat. The preferred embodiments essentially comprises a unibody frame with two aerodynamic stabilizers, a towing means, a deck area and at least one seat attachment/extension means.

The frame includes an upwardly-sloped front end, a pair of parallel, elongated box-shaped hulls, a seating area, forward and rear decks, stabilizer structure and side rails having hand holds formed therein. The upwardly-sloped front end creates an upward thrust against the water surface as the glider is towed, allowing it to glide on its two hulls. The stabilizers are provided to minimize capsizing and provide additional lift as the glider is towed. A tow chain is securely attached to the respective front ends of the stabilizers. Besides serving the obvious function, the hand holds are also utilized to drain any standing water from the seating area.

An extension may be attached at the rear (aft) of the glider to provide a seat for an additional rider. The extension is designed so that it may easily attach and detach from the glider frame.

Accordingly, it is a principal object of the invention to provide a shallow, user-friendly water glider that is buoyant, lightweight and easy to board.

It is a further object of the invention to provide a water glider which is equipped with stabilizer structure for decreasing the chances of capsizing.

A further object of the invention to provide a water glider which can be modified to have one seat or two seats.

Still another object of the invention is to provide a water glider having plural hand holds for enhancing safety.

Another object of the invention is to provide a watercraft with a configuration which allows the watercraft to glide through the water on a double-hulled structure.

It is an object of the invention to provide improved elements and arrangements thereof in an apparatus for the purposes described, which apparatus is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
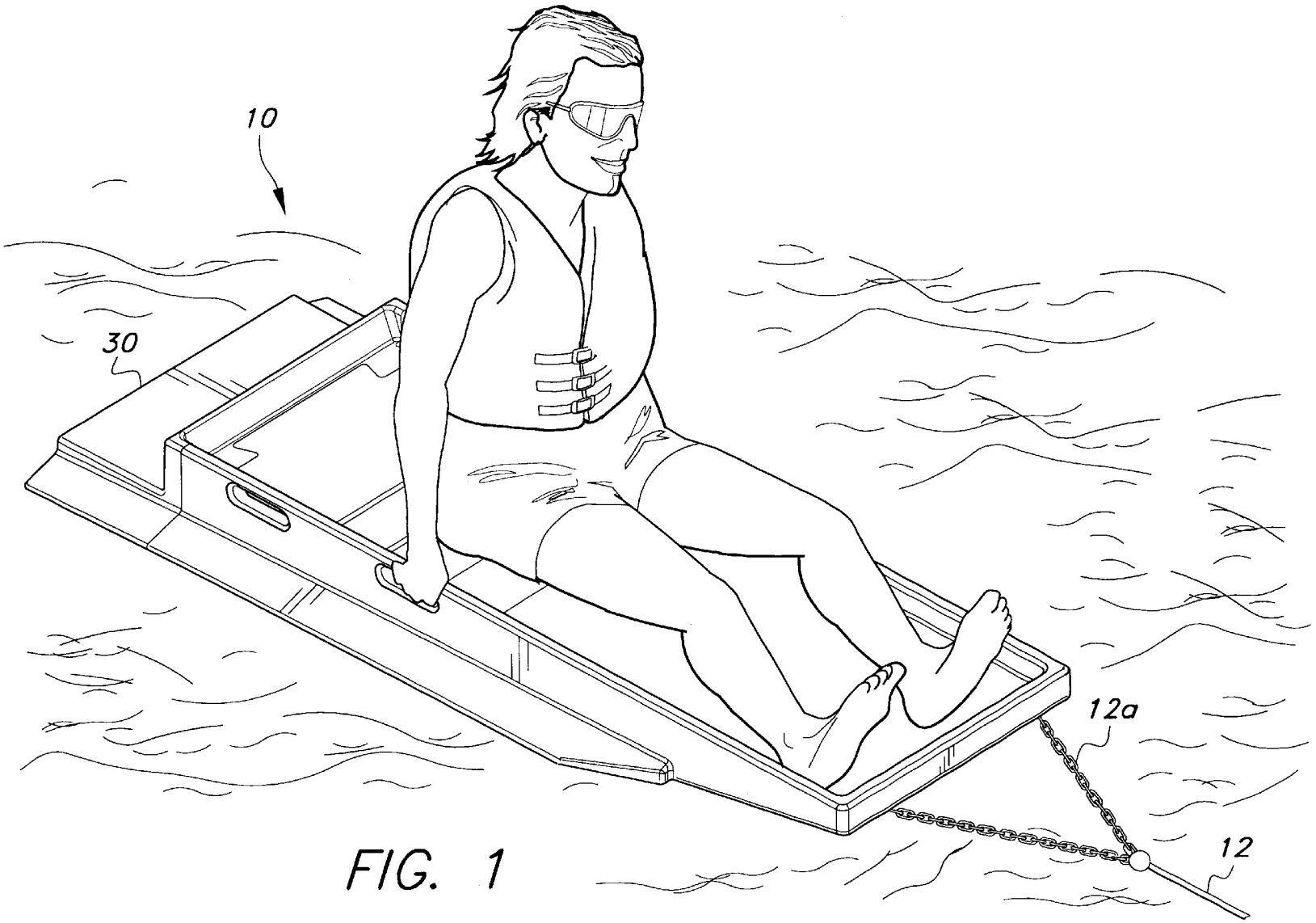
FIG. 1 is an environmental, perspective view of a water glider according to the present invention.

The present invention, as shown in FIG. 1 in its operating environment, is a water glider generally indicated at 10. Glider 10 is adapted to be towed by a motor boat (not shown) by means of a tow cable 12 and chain 12*a*.

Figure 2:
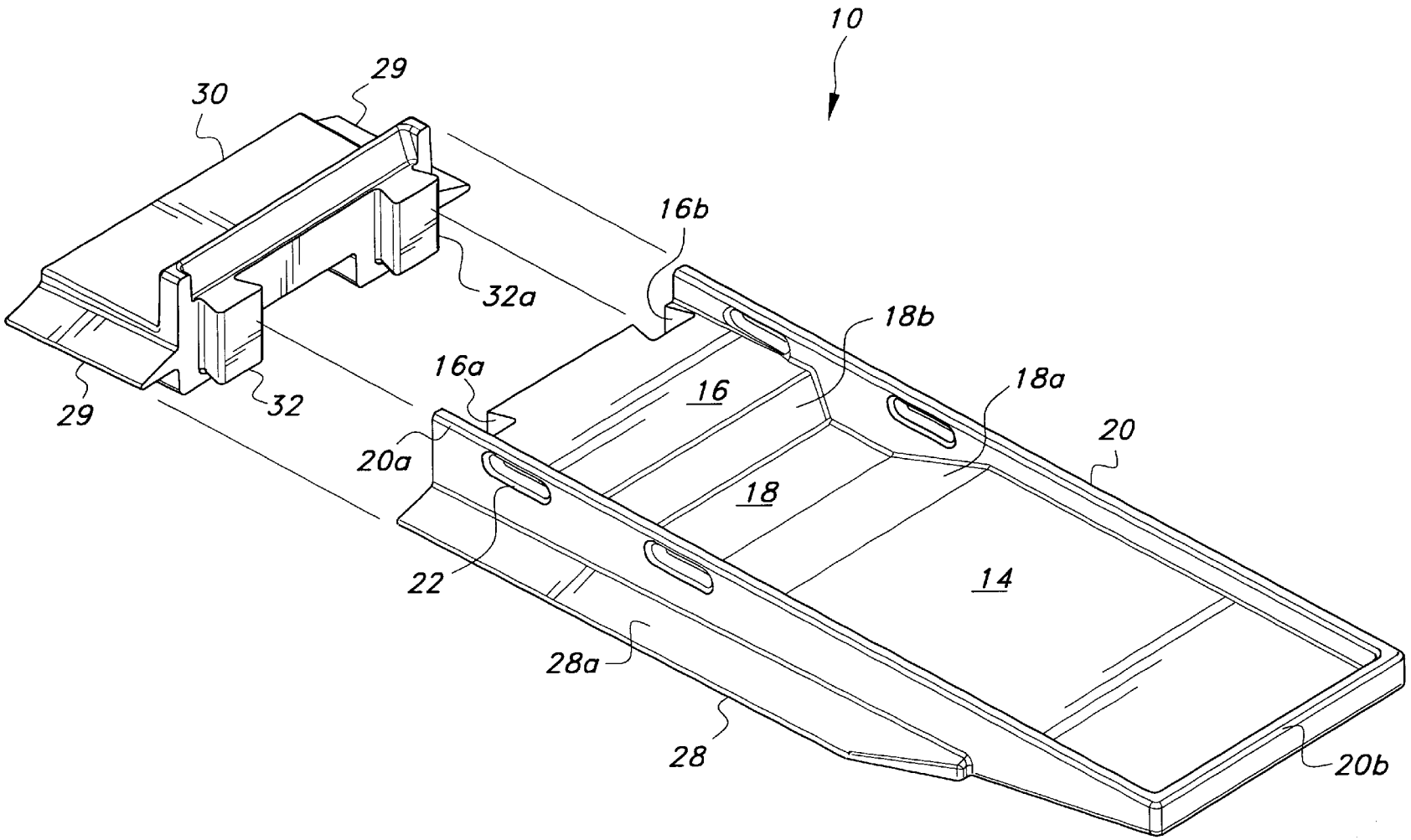
FIG. 2 is an exploded, perspective view of a water glider and extension according to the present invention.
Figure 3:
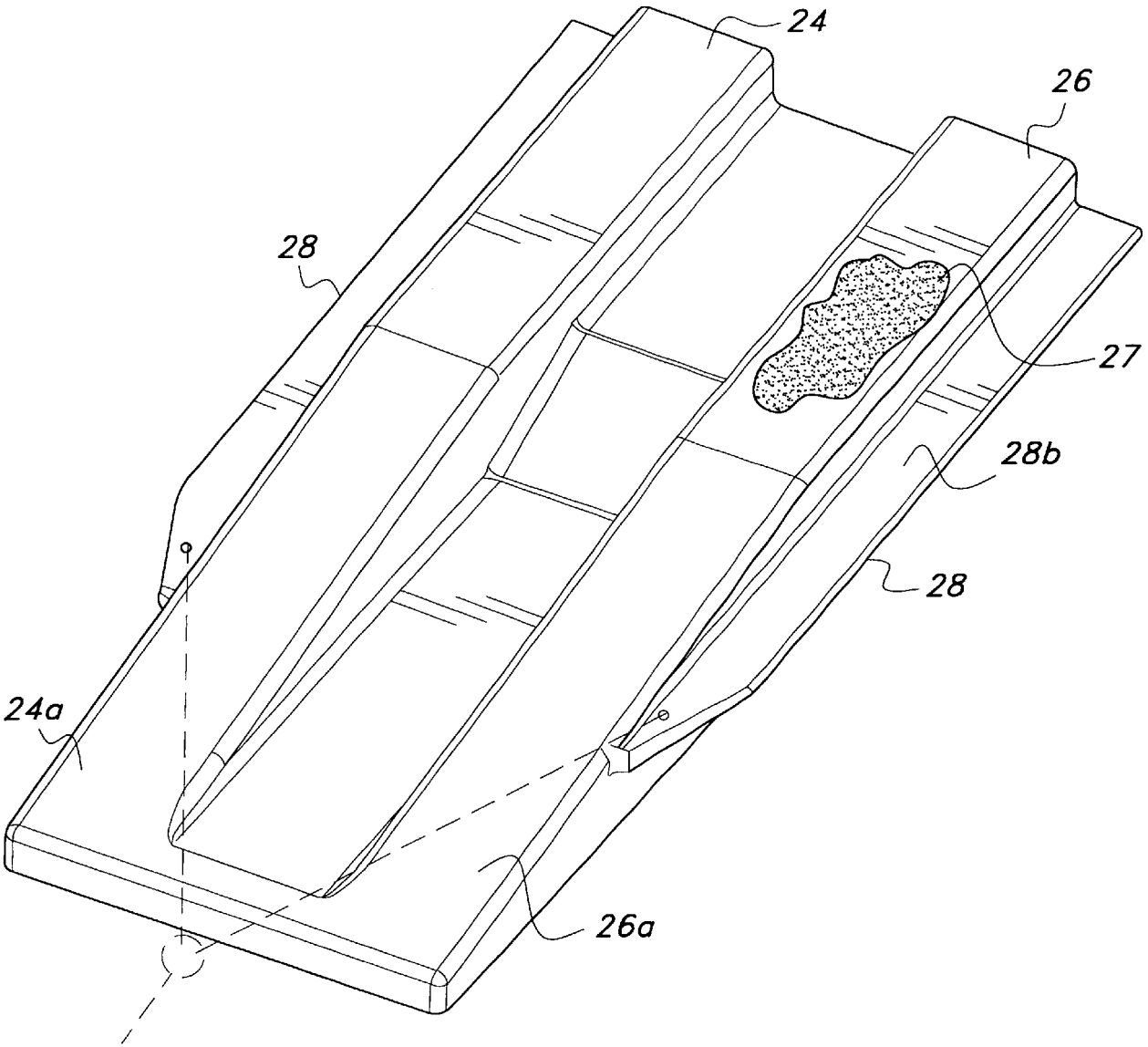
FIG. 3 is a perspective view of the bottom of a water glider according to the present invention.

As best seen in FIGS. 2 and 3, glider 10 comprises a frame structure having a forward deck 14 and a rear deck 16 defining the respective fore and aft portions of the glider. A horizontally oriented seat 18 is disposed between decks 14 and 16. Seat 18 consists of forward portion 18*a* which slopes upwardly from seat 18 to meet with deck 14. A rear portion 18*b* slopes upwardly from seat 18 to meet rear deck 16. The slope of rear portion 18*b* is less than that of front portion 18*a* so that a user can comfortably sit in the glider as illustrated in FIG. 1. Rails 20, 20*a*, and 20*b* enclose the respective sides and the front end of glider 10. Side rails 20, 20*a* are between fifty-four and sixty-eight inches long and are approximately five inches high at the front end of the glider and approximately eight inches high at the rear end. Front rail 20*b*is approximately twenty-two inches wide. Rails 20 and 20*a* are provided with hand holds 22 for purposes as described above. The underside of the glider is equipped with parallel hulls 24 and 26. Hulls 24, 26 extend the entire length of the glider and are connected at their front ends by portion 25. Hull forward portions 24*a* and 26*a* define an upward slope such that the front end of the glider is tilted at an angle of forty-five degrees relative to the horizontal. As indicated above, this slope or tilt allows the water surface to create an upward thrust on the glider, thus allowing the glider to glide on the hulls 24, 26. The hulls are hollow and are filled with buoyant material (cork, styrofoam, etc.) 27 to enhance the floatation capability of the glider. A pair of aerodynamically designed stabilizers 28 are attached at each side of the glider. Stabilizers 28 function to keep the glider from capsizing at towing speeds. Each stabilizer 28 has a top surface 28*a* which is angled downwardly from the side of the glider and a bottom surface 28*b* which extends substantially perpendicular to the side of the glider. Top surface 28*a* forms an angle of approximately one-hundred-sixty-two degrees with the horizontal plane of bottom surface 28*b*.

Figure 4:
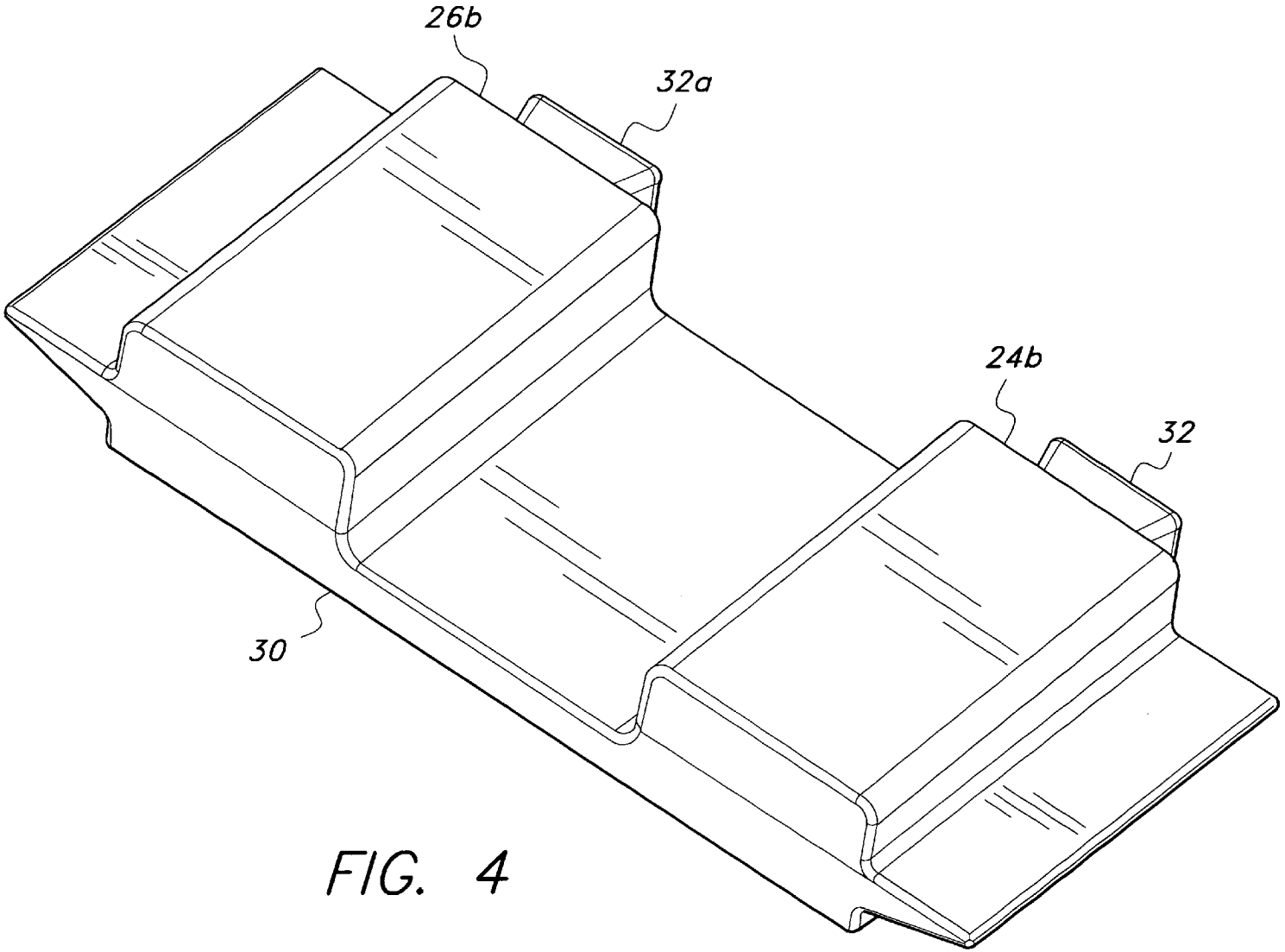
FIG. 4 is a perspective view of the bottom of an extension of a water glider according to the present invention.

A removable extension 30 (FIGS. 2 and 4) is provided to accommodate a second passenger. Extension 30 is configured with key elements 32, 32*a* which are insertable into slots 16*a*, 16*b* formed in the rear of glider 10. Extension 30 includes aerodynamic parts 29 which are configured to mesh with and extend the stabilizing structure 28. Extension 30 further includes hull portions 24*b*, 26*b* which mesh with and extend hulls 24, 26. Any suitable and convenient fastening devices (not shown) can be utilized to quickly attach extension 30 to glider 10.

The various parts of the instant invention as described above may be fabricated from any suitables light-weight material (wood, fiberglass, plastic, etc.) Keeping in mind that the glider may be subjected to salt water use.

It is to be understood that the present invention is not limited to the embodiments described above, but encompasses any and all embodiments within the scope of the following claims.

I claim:

1. A water glider comprising:

a unibody frame, said frame having a front end, a rear end, two sides, a top surface and a bottom surface;

a forward deck, said forward deck defining the front end of said frame;

a rear deck, said rear deck defining the rear end of said frame and spaced a horizontal distance from said forward deck;

said front end tilted upwardly at an angle of forty-five degrees relative to a horizontal plane;

a first seating area spanning said horizontal distance between said forward deck and said rear deck, said first seating area comprising a planar horizontally positioned member sandwiched by two planar angularly positioned members;

a first pair of elongate, hollow hull members, said first pair of hull members disposed on the bottom surface of said frame and disposed to extend from said front end to said rear end of said frame;

first and second aerodynamic stabilizers attached at each respective side of said frame;

a second seating area comprising:

an extension member having an upper planar surface, a bottom surface, a front face, a rear face and a pair of side walls;

third and fourth aerodynamic stabilizers disposed on each of said pair of side walls; and a second pair of elongate, hollow hull members disposed on the bottom surface of said extension member, said second pair of elongate, hollow hull members disposed to extend from said front face to said rear face; and third means for removably attaching said second seating area to said rear end of said frame.

2. A water glider as defined in claim 3, wherein said third means for removably attaching includes a pair of slots formed in said rear end of said frame.

3. A water glider as defined in claim 2, wherein said third means for removably attaching includes a pair of key members disposed on said front face of said extension member.

4. A water glider as defined in claim 3, wherein each said first pair and said second pair of elongate, hollow hull members is filled with buoyant material.

5. A water glider as defined in claim 4, including a pair of side rail members each of said pair of side rail members attached to and extending along a respective one of the two sides of said frame.

6. A water glider as defined in claim 5, including at least one hand hold disposed in each said pair of side rail members.

7. A water glider as defined in claim 6, including a front rail member, said front rail member attached to and extending across the front end of said frame.

8. A water glider as defined in claim 7, including a towing chain attached to said first and second aerodynamic stabilizers.

* * * * *